US005655511A

United States Patent [19]

Prabhu et al.

[11] Patent Number: 5,655,511

[45] Date of Patent: Aug. 12, 1997

[54] GAS FIRED CONVECTION OVEN

[75] Inventors: Gajanan Madhav Prabhu, Cary; Mark J. Smith, Fuquay-Varina, both of N.C.

[73] Assignee: SouthBend-A. Middleby Company, Fuquay-Varina, N.C.

[21] Appl. No.: 677,484

[22] Filed: Jun. 27, 1996

Related U.S. Application Data

[63] Continuation of Ser. No. 266,214, Jun. 27, 1994, abandoned, which is a continuation-in-part of Ser. No. 979,203, Nov. 20, 1992, Pat. No. 5,361,749, which is a continuation-in-part of Ser. No. 833,889, Feb. 10, 1992, abandoned, and a continuation of Ser. No. 145,293, Oct. 29, 1993, Pat. No. 5,460,157.

[51] Int. Cl.[6] ..... F24C 15/32

[52] U.S. Cl. ..... 126/21 A; 126/21 R; 126/19 R

[58] Field of Search ..... 126/21 A, 21 R, 126/19 R

[56] References Cited

U.S. PATENT DOCUMENTS

| | | | |
|---|---|---|---|
| 3,831,579 | 8/1974 | Tamada et al. | 126/21 A |
| 4,108,139 | 8/1978 | Gilliom et al. | 126/21 A |
| 4,516,012 | 5/1985 | Smith et al. | 126/21 A |
| 5,361,749 | 11/1994 | Smith et al. | 126/21 A |

*Primary Examiner*—Larry Jones

*Attorney, Agent, or Firm*—Rhodes, Coats and Bennett, L.L.P.

[57] ABSTRACT

A restaurant sized convection oven has a single-sided blower wheel with forward curved fins. A pair of spaced parallel baffle plates are in front of the blower, each plate having a central hole or opening. A connecting duct extends a passageway for flue gas to pass into a space between the plates. The hole in the plate nearest the blower has a diameter which is larger than the diameter of the hole in the plate nearest the baking cavity in order to create a suction in the connecting ducts for drawing in the flue gas. The ratio of flue gas to hot oven air is established primarily by the cross-sectional areas of the connecting duct and the two holes. One of the baffle plates has edge cut outs which eliminate the need for a blower scroll.

27 Claims, 7 Drawing Sheets

GAS FIRED CONVECTION OVEN

REFERENCE TO EARLIER APPLICATION

This application is a continuation of Ser. No. 08/266,214, filed Jun. 27, 1994, now abandoned, which is a continuation-in-part of application Ser. No. 07/979,203 filed Nov. 20, 1992, now U.S. Pat. No. 5,361,749 which is a continuation-in-part of Ser. No. 07/833,889, filed Feb. 10, 1992, abandoned and a continuation application Ser. No. 08/145,293, filed Oct. 29, 1993 now U.S. Pat. No. 5,460,157.

BACKGROUND OF THE INVENTION

This invention relates to new and improved convection ovens and more particularly to convection ovens with improved burners for establishing a lower profile and a better air flow pattern.

Many current convection ovens use burners made of an elongated horizontal tube or tubes made of sheet metal or cast iron. Usually both of these types of burners require a relatively tall combustion chamber for two reasons. First, there must be enough space inside the combustion chamber for flames to rise vertically above the burner without damage to overlaying structures. Second, there must be enough space within the combustion chamber to house the elongated burner which may extend throughout the entire length or depth of the oven.

Because of the cost, size and mode of operation, tubular burners are usually located within a combustion chamber below a baking cavity within the oven. This location necessarily causes the burner skin temperature to increase to such a degree that the life of a sheet metal burner may be shortened. There may also be an adverse effect upon the bottom wall of the oven itself. Cast iron burners are more durable than sheet metal burners. However, they are also more expensive than sheet metal burners, and so make the oven more expensive for the consumer to buy.

The tubular type of burner also has a substantial effect upon the overall height of the oven which must be correspondingly tall in order to contain the relatively tall combustion chamber, especially with the need for flame space above the burner. That resulting large size of the oven not only adds to its cost, but also means that when one oven is stacked on top of another, the top oven may be too high for some people to easily reach in.

DESCRIPTION OF THE PRIOR ART

Three examples of prior convection ovens are found in U.S. Pat. Nos. 4,516,012 (Smith et al.); 4,867,132 (Yencha); and 4,928,663 (Nevin et al.). The inventive oven contains an inshot burner which does not require substantial flame space above it. The improved flue gas flow allows for a reduced overall width and height of the inventive oven by doing away with flue gas passageways on two sides and above the cooking cavity.

SUMMARY OF THE INVENTION

There are a number of other considerations that go into the design of an oven. For one thing, the oven requires controls which usually cannot tolerate the heat (or at least the maximum heat) of the oven. Therefore, these controls must be protected from the extreme heat. Another problem is that, for maintenance and convenience of servicing, these controls should be accessible from the front of the oven, without requiring any movement of the oven or a maintenance access space around the oven.

This need for cooling and for front servicing leads to secondary problems. First, a location of burners in the front of the oven creates heat in the area where the controls should be located. Also, the intake of combustion air required by the burners leads to open spaces (usually covered by louvers or the like) in the front of the oven. If the ovens are stacked, as intended with this oven, the bottom oven will very likely have its air intakes very close to the floor. The custom in many restaurants is to hose down the floor, which leads to a spray of water being deflected in random directions. As a result, water enters the oven via the air intake louvers. This causes pilot flame outages, electrical short circuits, premature failure of oven parts, and downtime while the ovens cannot be used. Thus, an attractive design will have means for pulling cool air into the front of the oven without exposing the interior of the oven to ambient water.

These and other mechanical and structural considerations must be balanced against the basic requirement of the oven, which is to bake a food product. That, in turn, requires air flow patterns which maintain uniform heat throughout all parts of the oven cavity. Many people, agencies, trade associations, and the like have unsuccessfully attempted to quantify principles, rules, and mathematical analyses which would lead to predictable heat distribution. However, the end results of such attempts have been either a failure or less than useful.

Therefore, the engineering problem is to design a structure to bake appropriate foodstuff placed in the center of the oven. Then, experiment by expanding the cooking throughout the oven in order to find where the baking is faster or slower. Hamburger buns are exemplary of the food stuff used to conduct the baking tests. The bun is properly baked when its outside is acceptably browned and its inside center is fully baked.

In the class of oven to which the invention is directed a standard baking pan is 1"×18"×26". For a single baking load, the oven accepts a stack of these pans mounted in racks that are supported by side rails. Initially, the full oven baking test is conducted with the oven as fully loaded as possible. The oven is properly designed when the buns are uniformly baked across the length and width of all pans.

This class of oven usually comes in two types. A "high firing" oven consumes 90,000 BTU/hr. A "low firing" oven consumes 40,000 BTU/hr. Ideally, the same oven could be used as either a high or a low firing oven. Therefore, a desirable criterion of oven design is uniform baking at either of the firing levels.

Also, the inventive oven is directly fired. A directly fired oven is one in which, unlike an indirectly fired or a muffle style oven, flue gas products come directly into contact with food. Consequently, direct fired ovens require relatively less heat energy to cook food as compared to the heat required by indirectly fired ovens. Because it is directly fired, the heat is brought into the oven and, therefore, onto the food quickly. This speeds cooking but tends to burn food. Therefore, even heat is important in the inventive oven especially on high BTU (90,000) units.

Accordingly, an object of the invention is to increase the burner life. A more particular object is to provide a burner which is used to heat the oven, while the burner itself remains outside of the combustion chamber thereby extending the burner's life.

Another object of the invention is to reduce the height of the oven. In particular, the object is to reduce the height of the oven by reducing the height of the combustion chamber and by reducing the space above the cooking cavity. Here, the object is to place the stacked ovens in a double deck configuration at a convenient height for the workers, and especially for the shorter workers.

Yet another object of this invention is to reduce the width of the oven. In particular, the object is to reduce the width of the oven by improving the flue gas flow. Here the object is to reduce the floor space requirement in a kitchen for oven installation and operation. Another object is to make an uppermost one of the stacked ovens low enough so that it is easier for people to work with them.

A still further object of the invention is to place all controls on the front of the oven. Here an object is to bathe these controls with cooling air. In particular, an object is to accomplish these objects without simultaneously providing open spaces through which external water may enter the oven, especially to make it easier to clean up a kitchen without damage to the oven.

Among other things, these objects are possible because there is no tubular burner which must extend throughout the inside length or depth of the oven. Its absence allows the combustion chamber height to be reduced partially by the diameter, flame height, and perhaps more, of the old tubular burner.

In keeping with one aspect of this invention, an inshot burner is positioned outside a heating chamber. When it is ignited, its flame projects into the heating chamber. Any suitable air movement device, such as a blower or impeller, pulls cool ambient air into the back of the oven, over the controls, and onto the burner. The resulting flue gases pass through a passageway under and in the rear of the oven cavity, into the cooking cavity and also forces some of the heated air to circulate within the inside of the cooking cavity, and then out a flue gas passageway at the top of the oven.

BRIEF DESCRIPTION OF THE DRAWING

A preferred embodiment of this invention is shown in the drawings, in which.

DESCRIPTION OF THE PREFERRED EMBODIMENTS

Figure 1:
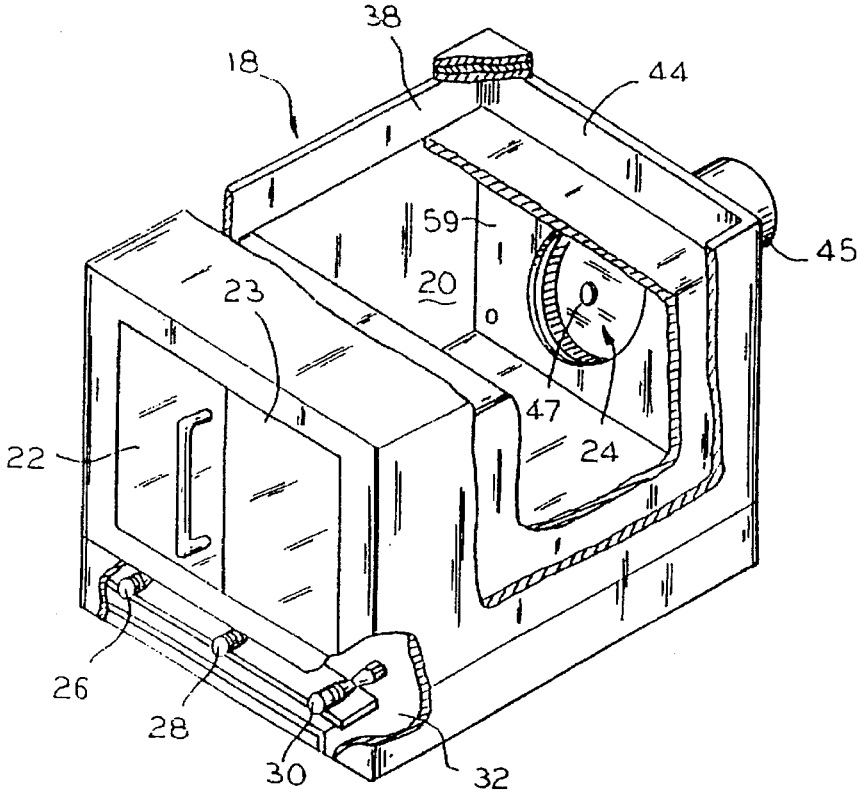
FIG. 1 is a perspective view of one embodiment of a convection oven, with parts of the outer and inner cavity walls cut away to reveal internal oven parts.
Figure 2:
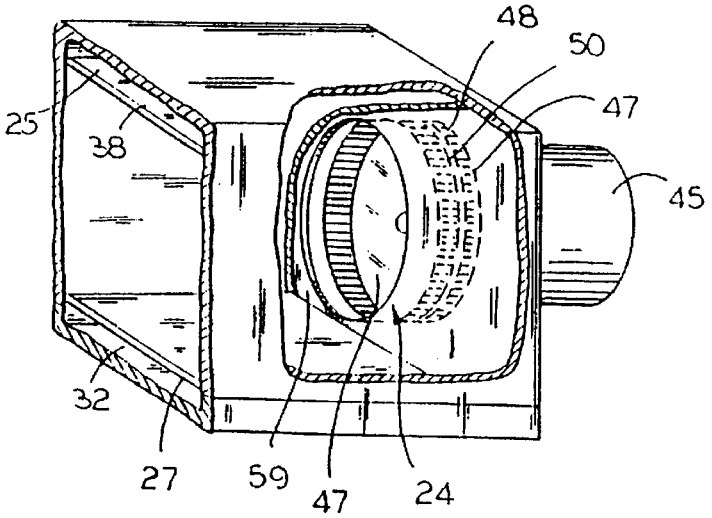
FIG. 2 is a perspective view partially cut away to show a bi-centrifugal blower which is useful in one embodiment of the invention.

As shown in FIG. 1, a low profile oven 18 comprises an insulated housing, defining a baking cavity 20 with two access doors 22, 23 on one side (front) and a blower 24 on an opposite (back) side. The oven housing may take any convenient form, shape, and size. It may have interior and exterior metal surfaces separated by suitable insulation.

Figure 8:
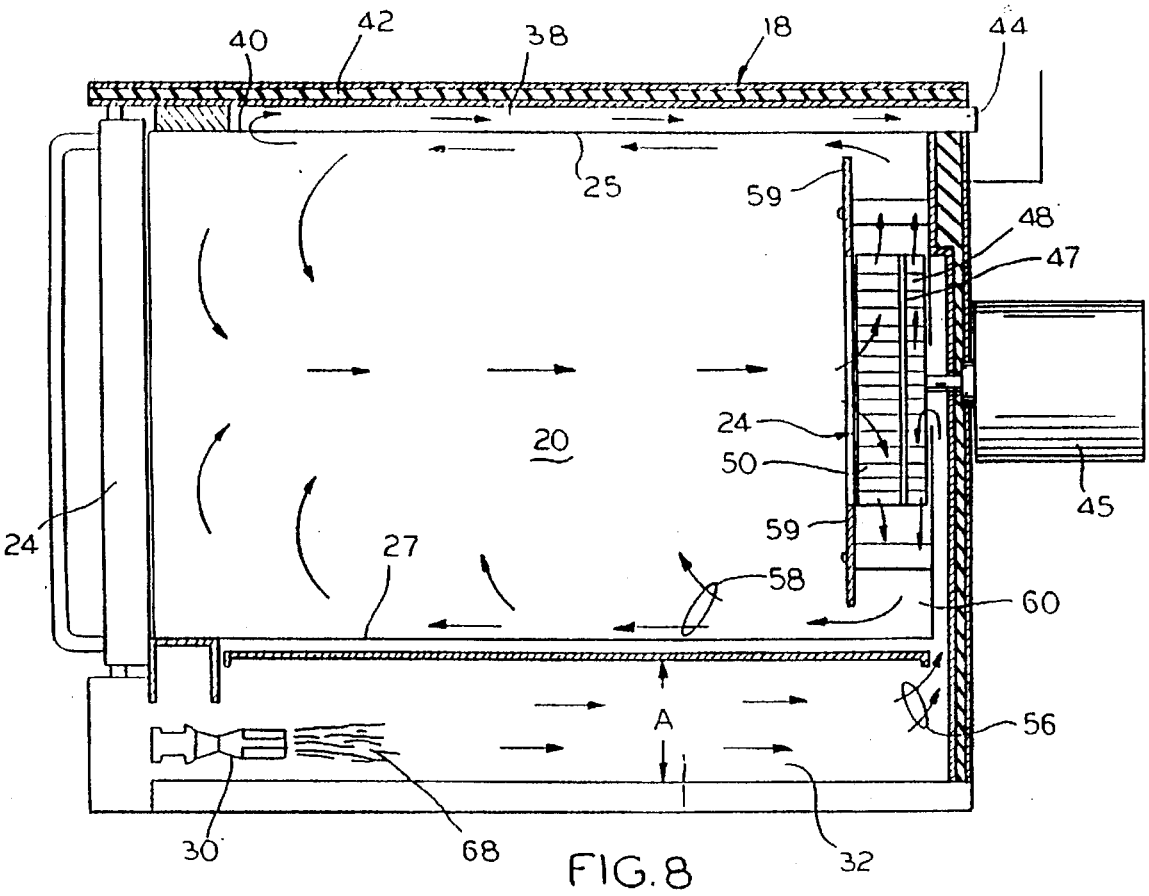
FIG. 8 is a cross sectional view showing the air circulation pattern within the first embodiment of the oven which uses a bi-centrifugal blower.

In greater detail, in one embodiment, the oven comprises an insulated enclosure housing 18 with a central baking cavity 20 defined on at least two sides by non-insulated walls 25, 27 (FIG. 8). On these two sides, channels 32, 38 form air passageways outside of the non-insulated walls. A first 32 of the channels, 32, is a combustion chamber formed under the floor of the oven cavity 20. A second of the channels, 38, is an exhaust formed over the ceiling of the oven cavity 20. Each of these channels 32, 38 has an opening to ambient external air for drawing air into and expelling air from the oven cavity. The preferred design is for the front of the exhaust passageway 38 to open into the baking cavity at exit hole 40 (FIG. 8) and ends in the back of the oven at an outlet port 44. The blower 24 draws in air through one of the channels 32, circulates air within the oven, and blows air out through the other 38 of the channels. Inshot burners 26, 28, 30, at the front of the oven heat the air inside the first channel or combustion chamber 32 (FIG. 1).

Figure 8A:
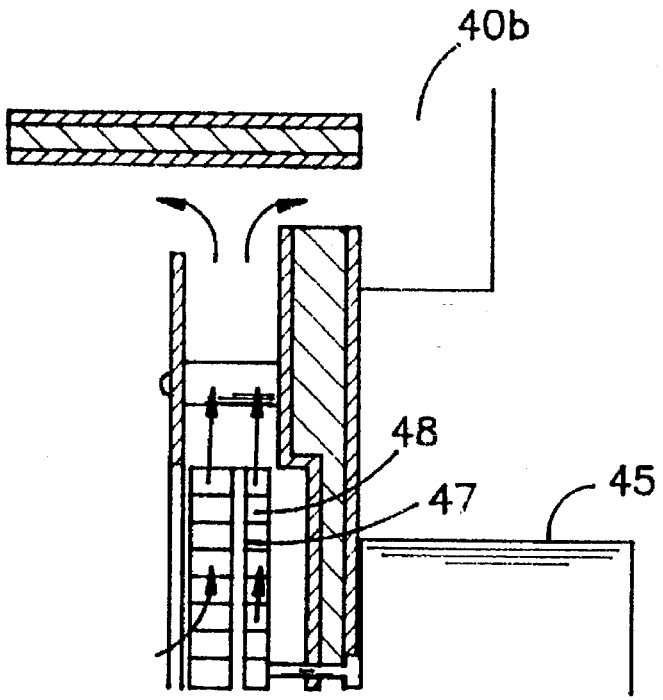
FIG. 8A is a fragment of FIG. 8 showing an exit or exhaust port in the rear oven wall.
Figure 8B:
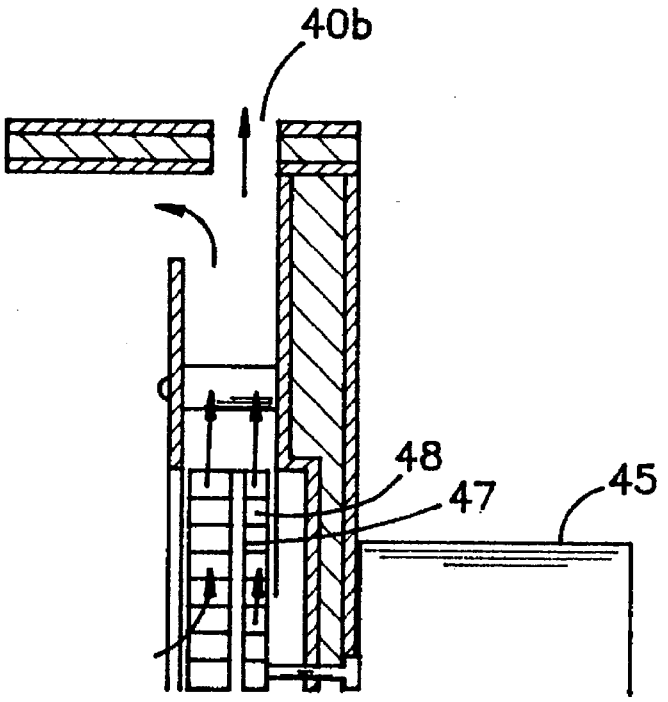
FIG. 8B is another fragment of FIG. 8 showing an exit or exhaust port at the back of the top or ceiling oven wall.

The inventive design preferably has the exit or exhaust hole 40 located in the top of the cooking cavity near the front of the oven. However, the exit or exhaust hole could also be locate behind the baffle either in the top at **40*b* (FIG. 8B) or on the back wall at 40*a* (FIG. 8**A) of the cooking cavity.

The advantage of the design with exit or exhaust hole 40 up front is efficiency. Since the entering flue gasses are mixed around the cooking cavity and the product to be cooked before exiting, all of the heat has a chance to be used before it exits. Generally, the exit temperature is no greater than the cooking temperature. The disadvantage of this design with the exit or exhaust hole up front is that the pressure created in the cooking cavity tends to be greater. This greater pressure tends to cause the door seals to leak since the heated air is forced past the door seals into the kitchen.

The design with the exit or exhaust hole in the back has the opposite advantages and disadvantages. In addition, the design with the hole in the back tends to be less expensive to manufacture because it contains less exiting air ductwork. It can also be shorter since no ductwork is required between the cooking cavity top and the oven top panel. Since the outlet is located behind the baffle (in a high pressure area) some of the entering flue gases go directly out the exit or exhaust hole without entering the cooking circulating air.

The motor 45 for circulating air is located outside the insulated housing of the oven cavity. In one embodiment, motor 45 drives bi-centrifugal blower 24, and circulates air within the oven and into exhaust passageway 38 and through the outlet 40 to the ambient air outside the outlet port 44. The blower 24 both draws in the combustion air and circulates the heated air within the oven.

The bi-centrifugal blower 24 comprises a rotating cylinder with a solid plate 47 in a central region. Blades 48 on rear side of the solid plate 47 draw ambient external air past the burner means 26, 28, 30 (for combustion) and then into the oven chamber (for heat circulation). Blades 50 on the front side of the solid plate 47 circulate air within the oven and expel it from the oven via channel 38. As the blower wheel rotates, a centrifugal force flings air outwardly from the periphery of the two sets of blades 48, 50, while drawing air into the center of the blades. The solid disk 47 separates these two air streams.

Hence, in this embodiment, there are two separate air streams 56, 58 (FIG. 8), separated by a solid plate 47, one stream 56 entering the back of blower blades 48 and the other 58 entering the front blower blades 50. Air stream 58 is a recirculation of air within the oven cavity 20. Air stream 56 is the hot air that is heated by the burners 26–30. These two streams 56, 58 mix at the outlets of the two sets of blower blades.

The blower 24 is located behind a baffle plate 59 which separates the oven cavity into two compartments, one including blower 24, the other forming the oven baking cavity 20. The space surrounding baffle plate 59 and a hole through the center of baffle plate 59 provide a path through which the heated air may flow under at the urging of the blower. The first or central opening provides a path for the passage of air from an interior of the oven to the blower. The baffle means 59 is surrounded by space between it and the oven walls. This space forms openings through which circulating air is expelled into the oven. Hence, the baffle plate 59 forces the air to flow around the sides of the oven and to return to the blower through the center of the oven. This flow creates a substantially uniform temperature throughout the oven cavity 20.

The oven area is heated from the draft 56 of hot air flowing through channel 32. More particularly, the blades 48 draw in a constant inflow of fresh air 56 which has been heated by the burners 26, 28, 30. This inflow forces an equal amount of internal oven air out the port 40 and through channel 38 over the top of the oven to outlet 44. This draft of air tends to prevent cooling air from entering the oven via port 44 and thus retains the heat in the oven.

Figure 9:
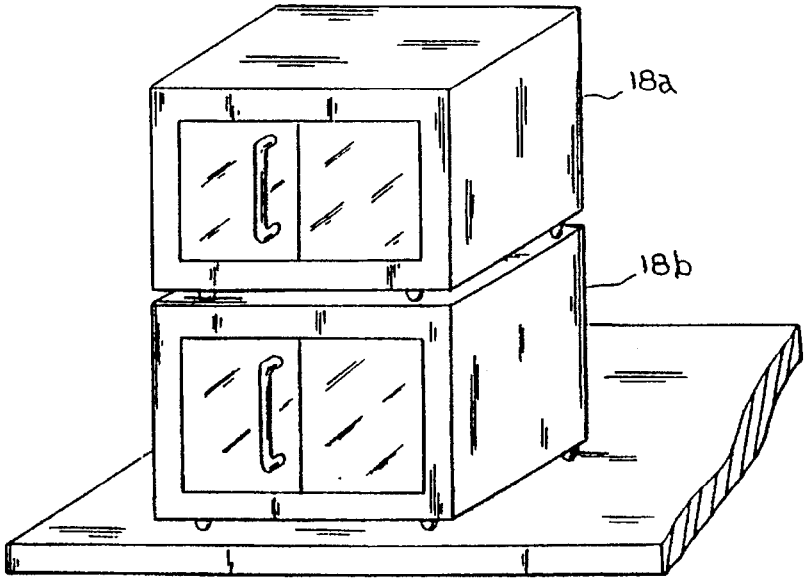
FIG. 9 shows two of the inventive ovens stacked one above the other.

Means are provided for maintaining the inshot burners 26, 28, 30 at the front of the oven since they are positioned at the front of the combustion chamber 32. By this, the overall height of the oven is reduced since the burners are not enclosed within a space below the oven cavity. In the prior art, these burners were often at the back of the oven or were under the oven. Among other things, when under the oven, a direct contact between a burner flame and the bottom surface 27 of the oven cavity 20 would soon warp, damage or destroy the oven. Therefore, when under the oven, the flame had to be far enough below the surface 27 to preclude such damage, which required a substantial height at A. The invention greatly reduces this height. Thus, as shown in FIG. 9, the invention provides for a plurality of stackable, low profile ovens, with the burner means heating the air at an entrance of—not within—the combustion chamber 32.

Figure 3:
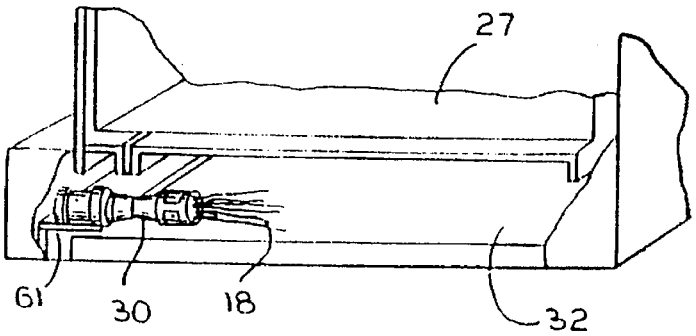
FIG. 3 is a perspective view, partially in cross section, to show an inshot burner in the new convection oven.

In keeping with one aspect of this invention, the traditional combustion tubular or cast iron burner is replaced by one or more modular inshot burners 26–30 (FIGS. 4–7). The inshot burners are located at a front of said oven for easy servicing and maintenance (FIGS. 1, 3, 8). Any suitable modules which are standard commercial items may be used. One suitable module is made by the Robertshaw Controls Company, New Stanton Division. Another supplier of suitable modules is Burner System International, Inc.

A transverse channel shaped support member 61 extends under and across the three burner modules (FIGS. 3–7). Each module is cradled in a concave shape 63 and secured in place by two screws 65, 67. The downwardly directed members of channel 61 rest on the floor of combustion chamber 32 and support the burners 26, 28, 30 in an elevated position.

Each of these modular burners has a somewhat cylindrical configuration and clips together with other modules to form an array of burners, in a horizontal row. These cylindrical members have somewhat wing-like projections 69 which provide means for feeding gas into adjacent modules as a pilot or lighting flame. A flame shaping means is located at the inner end of the cylindrical member to project a flame 68 into the combustion chamber or intake air channel 32. This flame 68 (FIG. 8) is somewhat reminiscent of a blowtorch flame. The heat from the flame is projected throughout the combustion chamber 32 and upwardly as the stream 56 through the blower and into the oven area 20.

Figure 6:
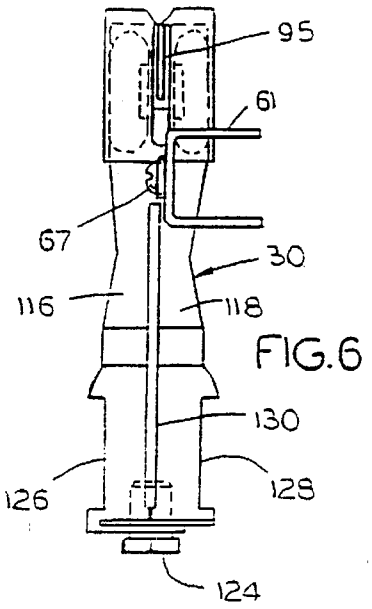
FIG. 6 is a side elevation of the inshot burner taken along line 6—6 of FIG. 4.
Figure 7:
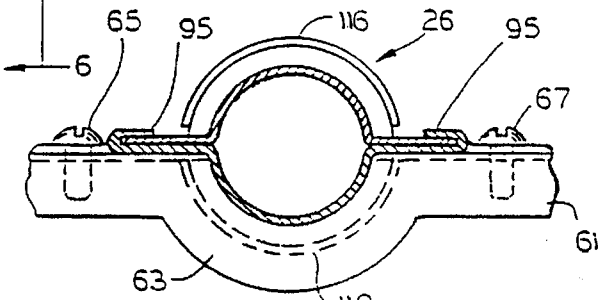
FIG. 7 is a cross sectional view taken along line 7—7 of FIG. 4.
Figure 5:
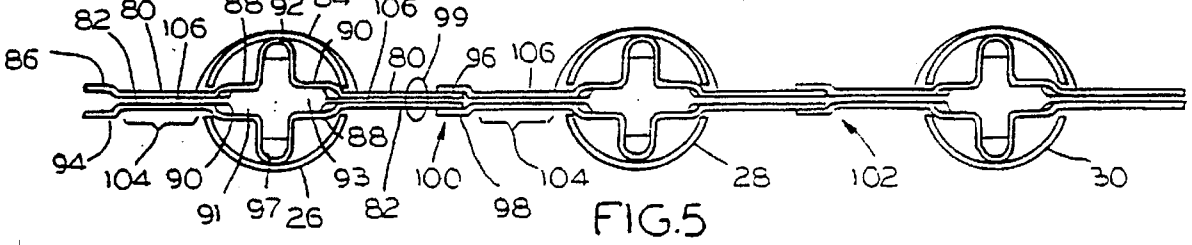
FIG. 5 is an end view of the bank of inshot burners taken along line 5—5 of FIG. 4.
Figure 4:
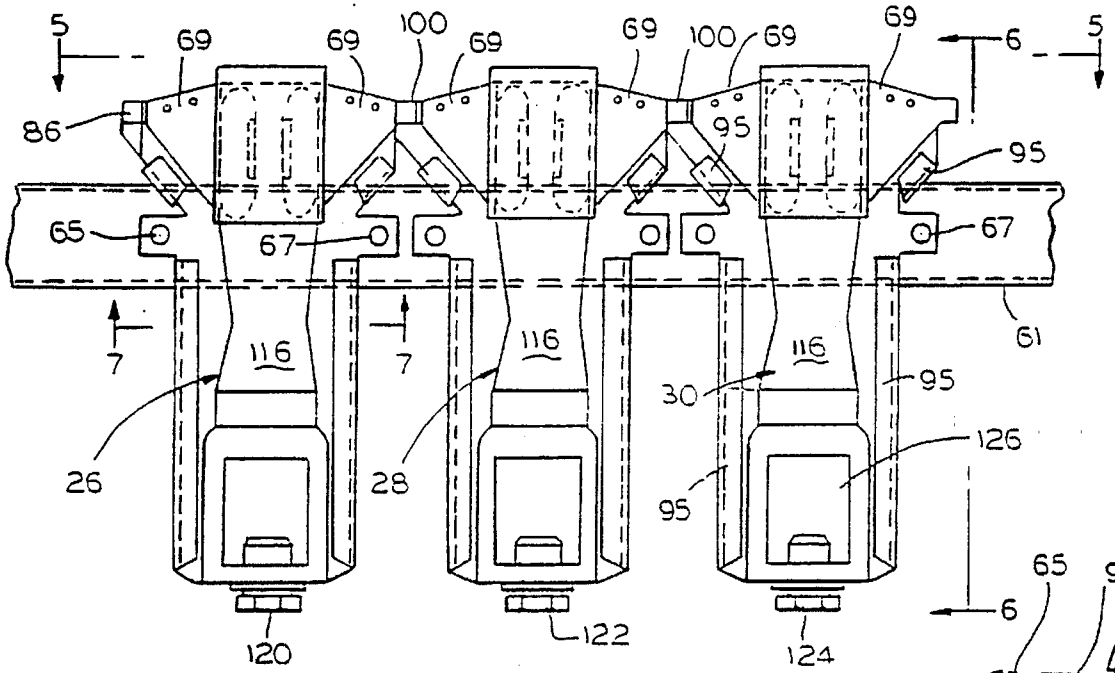
FIG. 4 is a top plan view of a bank of the inshot burners.

The construction of the inshot burners 26, 28, 30 is best seen in FIGS. 4–6. The burner is made of sheet metal, and therefore preserves the desirable low cost. However, since it is outside combustion chamber 32, it remains cooler and the sheet metal does not discolor, warp, disintegrate or otherwise become damaged by the heat.

The in-shot burners are located in a horizontal row to project a plurality of horizontal flames into the first channel 32, which extends across substantially the full width of the oven. By way of example, modular burner 26 (FIGS. 5, 6) is made from two mirror image stamped metal plates 80, 82, surrounded by a somewhat cylindrical member 84. One of the stamped metal plates 80 begins with a step 86, followed by a substantially flat member 87 and then half 88 of a horizontal flame shaping channel 91 which is completed by a complementary shape 90 formed on plate 82. Thereafter plate 80 has a second and vertical flame shaping channel 92, followed by its half 90 of the horizontal channel 93 completed by shape 88 on plate 82. Thus, there are four substantially U-shaped channels 91, 92, 93, 97, which together will tend to shape the flame in a known manner.

The other plate 82 is a mirror image of plate 80. Metal parts are crimped together as at 95 (FIG. 4). When those two plates are joined together in a face-to-face contact, the two steps 86, 94 form the open arms of a U-shaped member for receiving a tab 99 formed by the two flat face-to-face ends 96, 98 on the opposite ends of the two wing-like plates 80, 82. The interlocking feature of tabs 96, 98 and U-shaped members 86, 94 thus enable the modules to snap together. Therefore, as shown at 100, 102, the three modules 26, 28, 30 are connected by slipping the tabs 96, 98 on one end of wing-like plates 80, 82 into the U-shaped member 86, 94 on the opposite end of the plates.

In the flat areas, such as 104, the two plates 80, 82 are separated by a narrow space which provides a gas conveying means in communication between the burners, with a continuous gas carry-over channel 106 for conveying lighting gas to adjacent burners. This carry-over is particularly useful because, if the flame of any of the inshot burners should go out, it will almost instantly relight from the flame of the next adjacent burner.

The generally cylindrical shroud, 116, 118, is given a shaped waist of reduced cross section which enhances the burner efficiency. An orifice hood 120, 122, 124 is placed in the end of the cylindrical shroud 116, 118 to receive gas from a manifold leading to a connecting gas line (not shown) and to provide an orifice for emitting gas into an area having upper and lower windows 126, 128 (FIG. 6) for admitting combustion air. A gas stream is projected forward of the orifice in the orifice hood, past windows 126, 128, and through the waist of reduced cross section at the center of the cylindrical shroud. The high velocity gas jet streaming from the orifice pulls in combustion air through the windows 126, 128. The gas and combustion air mix homogeneously as they pass through the diverging part of cylindrical shroud 116, 118 downstream of the reduced cross section. At the far end of the waist, the projected gas-air mixture reaches the flame shaping members 88–92. If, for any other reason, flames are burning at one or more of the burners and no flame is burning at another burner, the gas passageway 106 at the flat areas 104, extending through the connectors 100 act as a channel for pilot lighting gas to ignite the burner which is out.

Thus, as shown in FIG. 8, substantially none of the height A is devoted to housing a burner, per se. Moreover, there is no need to provide a clearance above the flame of the burner which is not in the combustion chamber. The only space that is required is devoted to the passage of a stream of hot air and to those special needs that are required to build the assembly and to provide a workable device.

A second embodiment of the invention maintains a stream of cooling air across the oven controls. Also, this embodiment has no air intake open spaces in the front of the oven where water may enter the oven, as during a hosedown of a kitchen floor, for example, or other times when water is present.

Figure 11:
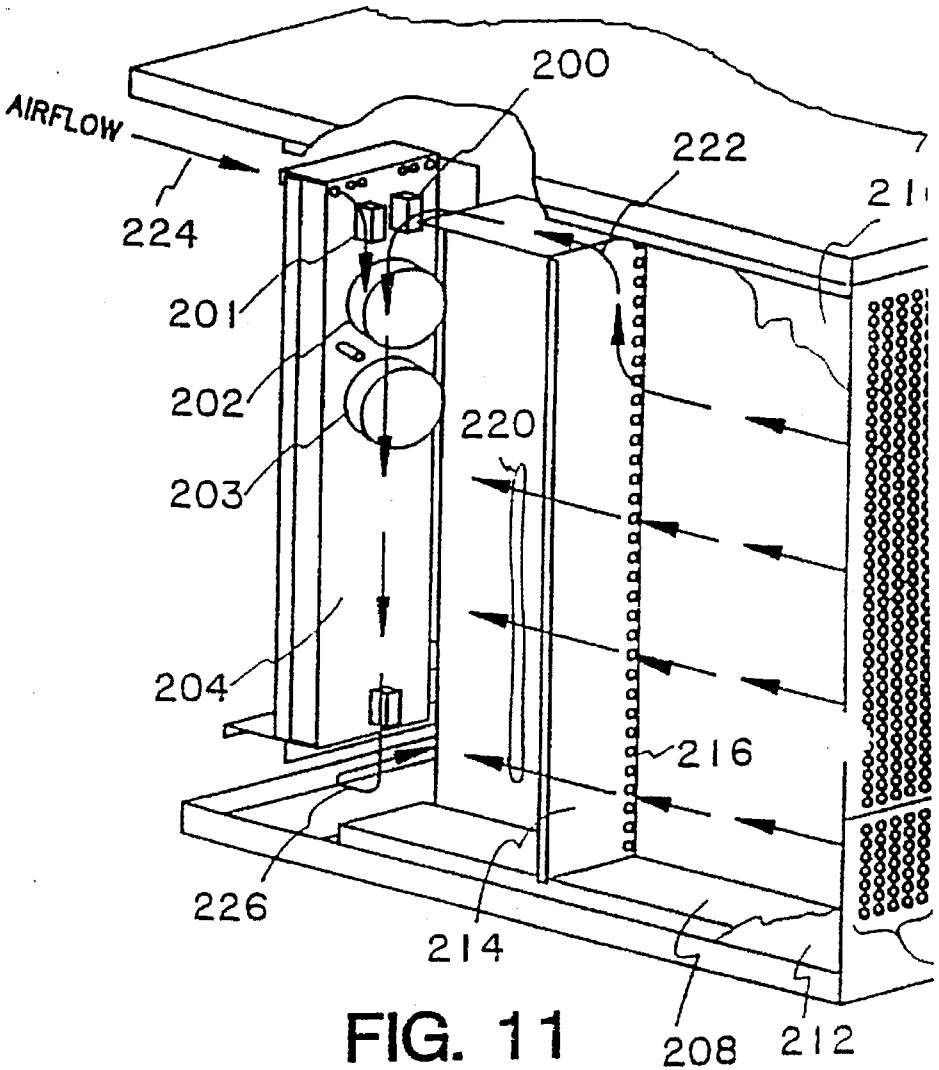
FIG. 11 is a partially cut away view, in perspective, especially for showing an air flow path for cooling the control panel.
Figure 10:
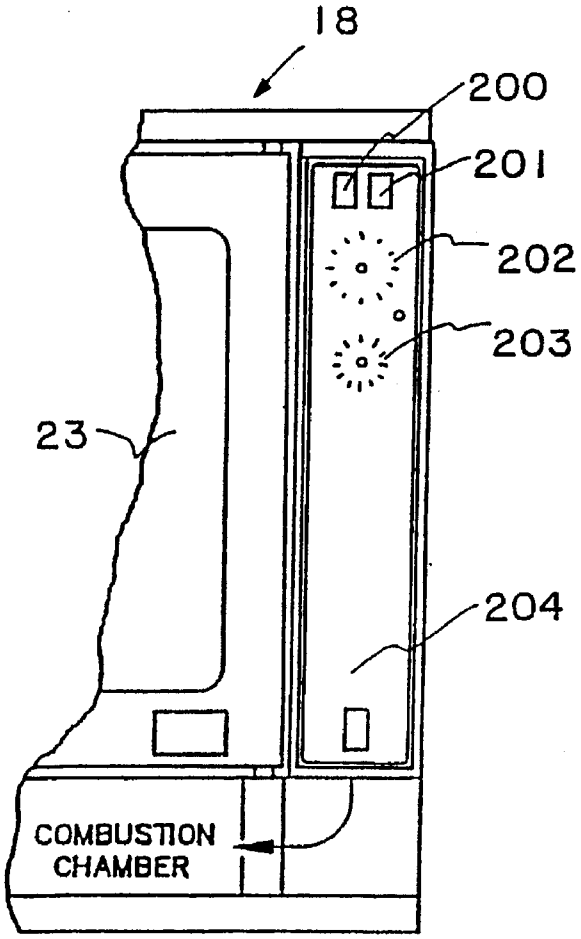
FIG. 10 is a front elevation showing the location of a control panel on the oven.

In greater detail, the controls 200–203 (FIGS. 10, 11) are mounted on a panel 204 on one side of the front access door 23. The particular functions of the controls are irrelevant. They may adjust temperature, provide a timed cooking cycle, etc. The point is that the controls may include components which cannot be exposed to heat. For example, these controls may include semiconductor devices, microprocessors, etc.

The back of the oven 18 has a number of air intake openings 206 (FIG. 11) through which ambient air may enter, under the urging of the blower 24. The cool entering air passes through a duct 208 formed between one side of the oven cavity 20 and an outside oven wall shown broken away at 210 and 212.

The inside of duct 208 is blocked by an air flow splitter panel 214 which has a number of holes 216 through which air may pass. The number of holes at 216 as compared to the number of holes at 206 determines the proportion of the air flow split. A first portion 220 of the air flows directly onto the back of the control panel 204. The second portion 222 of the air flows over the top of the panel 214 and down over the controls 200–203. Fresh air 224 may also flow in from the front, over the top of control panel 204, further cooling the controls. Hence, the controls are at all times bathed by a cooling stream of ambient air which has just been drawn into the oven.

Regardless of its source, the air flowing downwardly over the controls becomes the combustion air for the inshot burners 26, 28, 30, as indicated by the arrow 226. Once the combustion air reaches the inshot burners 26, 28, 30, the remainder of the air flows through the oven as shown in FIG. 8 and as described above.

Figure 12:
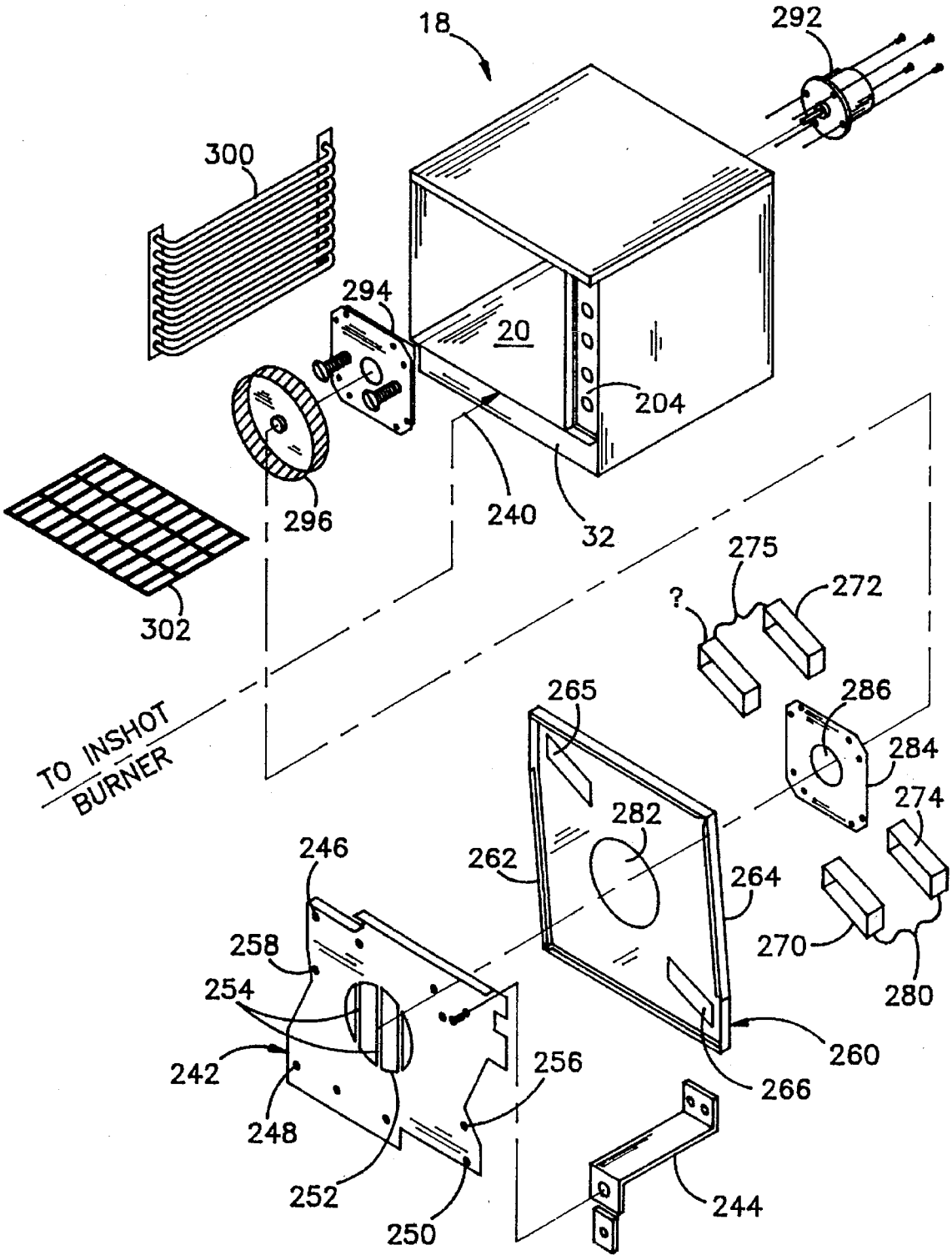
FIG. 12 is an exploded view of another embodiment of the invention, a single-sided blower wheel.
Figure 13:
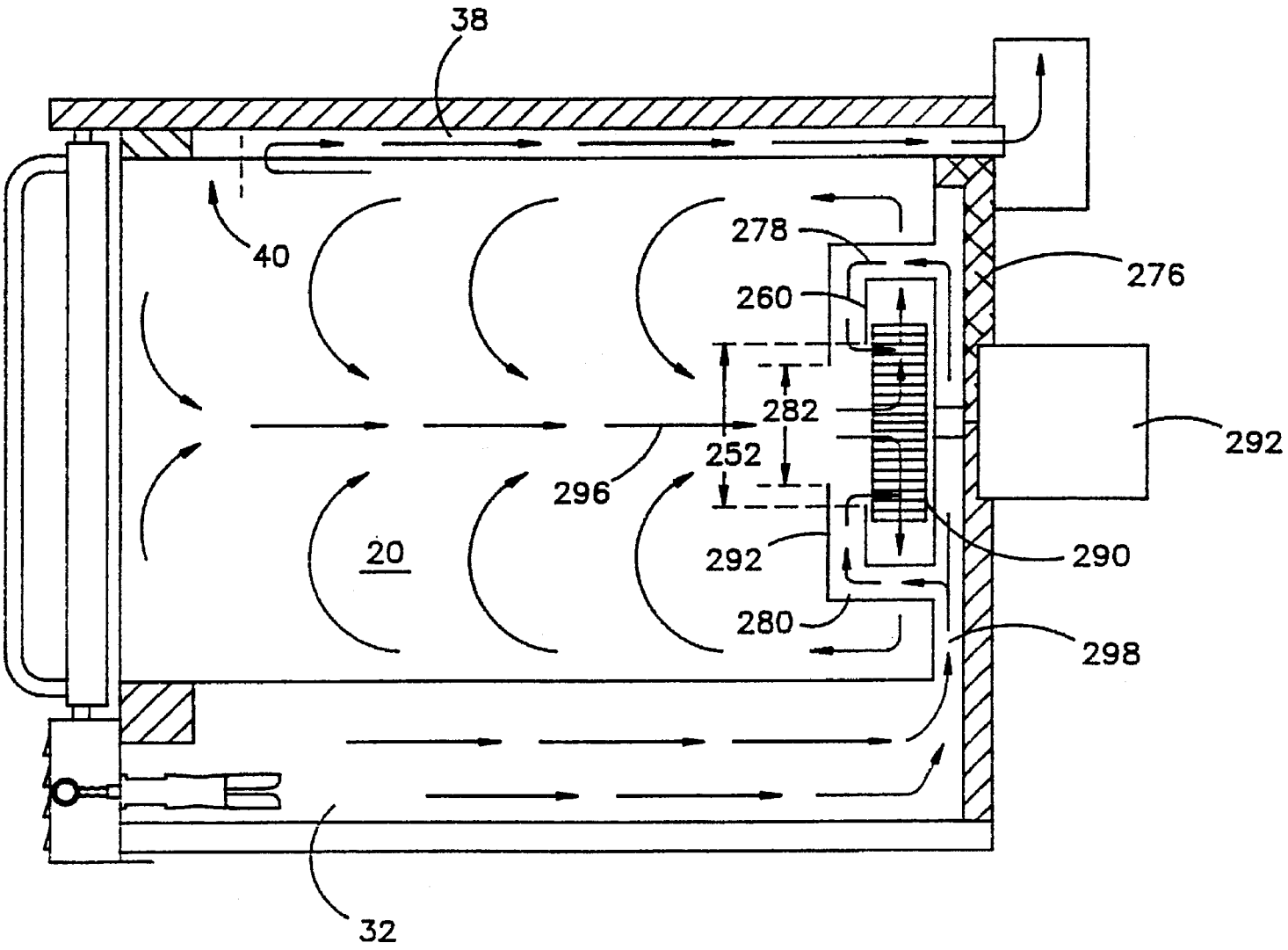
FIG. 13 is a cross-sectional view showing the air circulation pattern within a second embodiment of the invention.

The construction of an other embodiment of the oven using a single-sided blower is seen in FIGS. 12, 13. The oven 18 is generally constructed in approximately the same manner that has already been described, except for the differences described below.

The inflow of fresh air preferably bathes the back of the control panel with cool air in the manner described above in connection with FIGS. 10 and 11. The combustion air represented by arrow 226 (FIG. 11) is fed to the inshot burners, as indicated by the arrow 240 (FIG. 12). From there, the air is drawn through channel 32 to the back of the oven which is constructed as shown in FIGS. 12, 13.

Next to the oven cavity and in front of the back inside wall of the housing, there is an oven baffle plate 242 which is secured to the back of the oven housing by stand off connectors, one of which is seen at 244. The other stand off connector is bolted in place at 248. The opening at 252 is in front of the blower and has been cut out in order to leave pieces of the original plate in the form of bars 254 to keep out debris and to prevent people from sticking their fingers into the blower. The edges of oven baffle plate 242 are cut out at 256, 258 to promote an air flow since the blower has no surrounding scroll.

Behind the oven baffle plate 242 and spaced therefrom is a baffle ductway plate 260, which has vertical edges 262, 264 that are inclined to form the plate 260 into a parallelogram. Baffle plate 260 has two diagonally disposed openings 265, 266. A pair of connecting ducts 268, 270 are connected to fit against the back of the plate 260 and into openings 265 and 266. A second pair of connecting ducts 272, 274 are mounted on the back inside wall of housing 276 (FIG. 13) behind the blower. Ducts 268, 272 and 270, 274 (FIG. 12) telescope together to form ducts 278, 280 (FIG. 13) through which air may pass.

The two baffle plates 242, 260 are supported in a spaced parallel relationship. The baffle plate 242 facing the baking cavity 20 has a first hole 252 with a first diameter. The center of the second baffle plate 260 facing the blower 290 contains a second opening 282 with a second diameter. From an inspection of FIG. 13, it is apparent that the first diameter of the hole 252 in oven baffle plate 242 is smaller than the second diameter of hole 282 in the baffle ductway plate 260 that faces the blower in the high BTU unit. The low input unit has a smaller hole adjacent to the blower. This reduces the pull of flue gasses and, therefore, increases oven efficiency. The lower flue gas flow is acceptable on this low input unit due to a lower burner firing rate. The air moving perpendicularly across the opening causes a negative pressure in the duct 278, 280 which draws the flue gasses into the blower wheel. This will happen even if the opening 282 adjacent the blower is smaller than the first opening 252. The reduced pressure, and therefore, suction in ductways 278, 280, draws flue gas from air channel 32 and into the blower.

Behind the baffle ductway plate 260 is an optional plate 284 with a restrictor opening 286 formed therein (FIG. 12). Without the restrictor plate 284, the oven may be operated as a 90,000 BTU oven. With the restrictor plate 284 in place, the oven may be operated as a 40,000 BTU oven. With this restrictor plate in place, the hole in 282 is actually smaller than hole 252 to provide reduced vacuum for low firing rate. The contemplation is that restrictor plate 284 will be a factory installed option. However, it may be installs or removed by anyone at anytime.

A blower 290 is mounted on a shaft of a motor 292 which is mounted on a plate 294. In one embodiment, the blower was part No. 105041 sold by Revcor, Inc. of Carpentersville, Ill. Preferably, the motor/blower combination is mounted in the oven, from the front thereof, by bolting plate 294 to the back housing wall of the oven cavity. Of course, the orientation could be reversed and the motor could be bolted to the back of the housing 18. However, the preference is to have the oven fully serviceable from the front.

The blower wheel 290 is single-sided, preferably eleven inch diameter, with forwardly curved blower blades. The blower does not have any scroll. Instead, the two cut outs 256, 258 in oven baffle plate 242 create an imbalance of air discharge which produces an effect similar to the effect produced by a scroll. The cut out at 256 is much larger than the cut out at 258 and corresponds to the outlet of a blower scroll. The angles of the vertical side edges 262, 264 in plate 260 are designed to have no effect upon the air flow.

The blower 290 sucks the oven air into its center, as indicated by the arrows 296 (FIG. 13). The combination of center hole diameters at 252 and 282, along with the cross-sectional areas of ducts 278, 280 determines the amount of flue gas that is drawn in. By adjusting the ratio of the diameters 252, 282, the amount of suction in ducts 278, 280 may be changed. By enlarging or reducing the cross-sections of ducts 278, 280, more or less flue gas can flow into he combination of oven air and flue gas. Thus, the ratio of recirculated air to flue gas is determined by the geometry of this equipment.

The size of the exit opening 40 at the top of the oven determines the amount of air that can leave the oven at any given time. There must be a balance with the amount of flue gas, otherwise excess pressure will build-up in the cavity that will cause door seal leaks. Exit 40 is made sufficiently large so as not to be a controlling factor. The inside front position of exit opening 40 contributes to the uniformity of the air circulation pattern. Thus, the ratio of incoming flue gas to retained hot oven air versus the volume of expelled air results from a combination of the geometry of many parts.

Side rails 300 (FIG. 12) are secured to opposite sides of the oven cavity 20 to receive oven racks that hold bun pans which may be slid into the oven. In a preferred oven, there are, for example, eleven vertical tracks. A bun pan is first placed on a rack 302 on the fifth rail, in this example, in the center of the oven for the initial test baking which indicates whether the air circulation is or is not proper. The next test is to place buns on racks in all eleven positions that are supported by side rails 300 and then to test them for uniformity of their baking.

In operation of this embodiment, the flue gases are generated by the inshot burners at the entrance to the combustion chamber located below the bottom panel. The flue gases are drawn into the cooking cavity 20 by the single-sided blower wheel 290. More particularly, from the combustion chamber, the flue gases travel through the channel 32 to vertical rear duct way 298 (FIG. 13). The dimensions of an exemplary rear ductway is approximately ⅝-inch thick by approximately the width and approximately the height of the cooking cavity. The rear ductway is located between the blower wheel 290 and the inside rear panel of the oven. The rear ductway 298 has the two oven back connecting ducts 272, 274 (FIG. 12) attached thereto in order to provide an opening for the flue gases to enter. The baffle connection ductways 268, 270 are attached to the baffle ductway 260 which in turn is attached to the oven baffle plate 242. The baffle connecting ducts and the oven back connecting ducts telescope to form ducts 278, 280 (FIG. 13). The flue gases are drawn from the rear ductway 298 through the two interconnected connecting ducts 278, 280 and into the inlet side of the single-sided blower wheel 290. It is thought that the increased performance of this design over other blower designs is primarily due to the additional heat transfer surface contained inside to cooking cavity provided by the baffle ductway plate 260.

As indicated by arrow 296, the blower wheel 290 also draws hot cooking cavity air through a hole 252 in the oven baffle 242. This air velocity causes a negative pressure in the baffle connecting ducts 278, 280 which, in turn, draws the flue gases from the combustion chamber. As the air flow indicating arrows in FIG. 13 indicate, the recirculating hot oven air is drawn into the center of blower 290 while the flue gases are drawn circumferentially around the drawn-in recirculating air. Inside the blower wheel 290, the flue gases are mixed with recirculated cooking cavity air. The resulting mixture of gases and air is slung from the periphery of the blower wheel and into the space between the oven baffle 242 and the oven back wall. The oven baffle 242 assembly is shaped to provide a uniform mixture at an air velocity within the cooking cavity which provides a uniform baking performance throughout the oven cavity 20.

One drawback of many designs is that the mixture of flue gases and recirculating air exits the baffle area at velocities which are not uniformly distributed over the product to be cooked. This non-uniform velocity tends to overbrown areas that have higher velocity than other areas that have lower velocity air blown over them.

One reason for the non-uniform velocities is that inexpensive blower wheels used in this industry are wheels with forwardly curved blades.

One drawback of a forwardly curved blower wheel is that it works best with scroll-type enclosures and relatively small outlet areas. An application of a forwardly curved wheel inside a convection oven cavity requires a large outlet area. Because of this area need, forwardly curved wheels have been used without scroll enclosures; however, they do not perform very well without enclosures. With no other obstructions, the typical velocity/pressure profile for this arrangement would be high velocity/pressure areas in the upper left and lower right corners and low velocity/pressure areas in the lower left and upper right exit corners of the baffle. The greater the ratio of width versus height for the cavity dimensions, the greater the velocity/pressure values around the baffle exit points will be.

This invention direct-fired design increases efficiency by balancing, the inflow of recirculated air with the outflow of the mixture of recirculated air and flue gases. It also has a uniquely shaped baffle system that uniformly blows the recirculated air/flue gas mixture over the product to be cooked in order to provide an even browning. The inventive design blocks high pressure areas and opens low pressure areas in order to redirect high velocity/pressure areas to low velocity/pressure areas. The result is a uniform air velocity over the cooked product, which has minimized over-browning.

This has been accomplished by redirecting high velocity/pressure areas to low velocity/pressure areas by blocking high pressure areas and opening low pressure areas. Flue products enter the cooking cavity directly instead of being mixed as they are flung around the outside of the cooking cavity. This inventive direct fired design has the advantage of fast heat-up and cooking of products that are not sensitive to over-browning, such as baked potatoes, for example.

The new locations of the suction points in the rear ductway are wider than in some other designs. Other designs pulled the burner flames directly into the blower wheel and out into the center of the oven. The inventive design pulls only the flue gases up the rear ductway 298 before pulling them into the blower wheel. This enables better combustion since the burner flames are allowed to use the entire combustion chamber for the combustion process. In turn, this better allows the excess air pulled by the blower to be used for combustion. Less excess air leads to greater efficiency since excess air cools the oven.

Those who are skilled in the art will readily perceive how to modify the invention. Therefore, the appended claims are to be construed to cover all equivalent structures which fall within the true scope and spirit of the invention.

The claimed invention is:

1. A convection oven comprising a heating element, a closed and insulated housing having a baking cavity, an air passageway extending from said heating element through a duct under a floor of the baking cavity and up a communicating duct in the back of the oven, a baffle ductway plate located a predetermined distance in front of said duct in the back of said oven, at least one baffle connecting duct extending from said duct in the back of said oven through said baffle ductway plate, an oven baffle plate in front of and spaced apart from said baffle ductway plate to define a baffle chamber therebetween, a blower between said baffle ductway plate and said communicating duct in the back of said oven, said baffle ductway plate and said oven baffle plate respectively having a pair of holes formed in front of said blower, said blower for drawing air across said heating element and through said air passageway under said floor and said baffle connecting duct into said baffle chamber and out into said baking cavity.

2. The oven of claim 1 wherein said pair of holes have different diameters to create a suction in said baffle chamber.

3. The oven of claim 1 further comprising a restrictor plate for reducing the size of at least one of said pair of holes for enabling operation of said heating element at a reduced BTU firing rate.

4. The oven of claim 1 further comprising an exit opening at the top of said baking cavity for discharging oven air from said baking cavity to outside ambient air, whereby oven air circulates from said baking cavity into said blower, whereby heated air circulates through said baffle connecting duct, said baffle chamber, and into said blower where the blower mixes said oven air and said heated air and flings the mixed air out the periphery of said blower, and wherein the cross-sectional area of said exit opening, said baffle connecting duct, and said pair of holes in said oven baffle plate and said baffle ductway plate determine the ratio of heated air to oven air within said baking cavity.

5. The oven of claim 1 wherein the hole in said oven baffle plate comprises a cut out which leaves pieces of the original oven baffle plate to form protection bars that prevent foreign objects and people from touching said blower.

6. The oven of claim 1 wherein said blower is free of any scrolls, and said oven baffle plate has cut outs in its sides for discharging air flung out by said blower, said cut outs having a size and shape that simulate the discharge of a scroll on said blower.

7. The oven of claim 6 wherein said blower rotates clockwise, as viewed from said baking cavity and said cut outs are a relatively large area on the lower right hand edge of said oven baffle plate and a relatively small area in the upper left hand corner of said oven baffle plate as viewed from said baking cavity.

8. The oven of claim 1 further comprising control means located on the front of said oven, and means responsive to said blower drawing cool ambient air into said air passageway for bathing said control means with said cool ambient air before it reaches said heating element.

9. A gas-fired convection oven comprising a baking cavity, a blower for drawing cool ambient air past a heating element as combustion air, through a baffle connecting duct as flue gas, and into said blower, said blower drawing oven air from said baking cavity into said blower, said blower mixing said flue gas and said oven air and flinging said mixed flue gas and oven air into peripheral parts of said oven, and means comprising two spaced substantially parallel baffle plates in front of said blower for creating a suction within said baffle connecting duct for drawing in said flue gas, said means also comprising a pair of aligned holes in said two baffle plates.

10. The oven of claim 9 wherein an outer of said two baffle plates has a relatively large cut out along one edge and near one side and a relatively small cut out along an opposite edge and near an opposite side.

11. The oven of claim 9 wherein said pair of aligned holes have different diameters.

12. The oven of claim 11 further comprising restriction means for limiting the volume of flue gas to cause a low firing rate for said burner.

13. A convection oven, comprising:

a) an oven cavity enclosed within an insulated housing and including a baking cavity and a blower compartment;

b) a baffle separating the baking cavity from the blower compartment, the baffle including first and second plates that define a baffle chamber therebetween;

c) a central opening through the baffle for providing a path for air to flow from the baking cavity to the blower compartment, the baffle chamber being open to the central opening through the baffle;

d) a peripheral opening connecting the blower compartment with the baking cavity for providing a path for air to flow from the blower compartment to the baking cavity;

e) a heating element;

f) a hot air passageway communicating with the baffle chamber for delivering hot air from the heating element to the oven cavity; and g) a blower disposed in the blower compartment for drawing air past the heating element, through the air passageway, through the baffle chamber, and, along with air from the baking cavity, through the central opening into the blower compartment, and then for expelling mixed, heated air into the baking cavity through the peripheral opening.

14. The convection oven of claim 13 wherein said first and second plates are substantially parallel, said first plate being adjacent to the baking cavity and said second plate being adjacent to the blower compartment.

15. The convection oven of claim 14 wherein the central opening comprises a first hole through the first plate and a second hole through the second plate.

16. The convection oven of claim 15 wherein said first and second holes are in alignment with each other, and wherein the second hole has a greater diameter than the first hole.

17. The convection oven of claim 15 further comprising a restrictor plate mounted to the second plate for reducing the diameter of the second hole.

18. The convection oven of claim 14 wherein the air passageway includes a heating chamber extending beneath the baking cavity; a vertical ductway extending upwardly from a rear end of said heating chamber behind said blower compartment; and a connecting duct extending through said blower compartment to connect said vertical ductway with said baffle chamber.

19. The convection oven of claim 18 wherein the heating element comprises at least one inshot burner disposed near an open end of the heating chamber for firing into the heating chamber to heat air therein.

20. The convection oven of claim 13 wherein the peripheral opening is sealed off from the baffle chamber.

21. The convection oven of claim 20 wherein the peripheral opening comprises at least one opening between peripheral edges of the baffle and inner walls of the oven cavity.

22. A convection oven, comprising:

a) an oven cavity enclosed within an insulated housing and having an access door;

b) a double-wall baffle disposed inside the oven cavity for separating the oven cavity into a baking cavity and a blower compartment, the double-wall baffle including i) a first baffle plate adjacent the baking cavity, ii) a second baffle plate adjacent the blower compartment and spaced apart from the first baffle plate to define a baffle chamber therebetween, iii) a first hole through the first baffle plate and a second hole through the second baffle plate, the first and second holes defining a central opening through the double-wall baffle for providing a path for air to flow from the baking cavity to the blower compartment, the central opening also communicating with the baffle chamber, and iv) a peripheral opening separated from the baffle chamber for providing a path for air to flow from the blower compartment into the baking cavity;

c) a heating element;

d) an air passageway communicating with the baffle chamber for delivering hot air from the heating element to the oven cavity;

e) a blower disposed in the blower compartment for drawing hot air through the air passageway, through the baffle chamber, and, along with air from the baking cavity, into the blower compartment, and then for expelling mixed air into the baking cavity through the peripheral opening; and f) an exit opening for exhausting air from the oven cavity.

23. The convection oven of claim 22 wherein the first and second baffle plates are substantially parallel and wherein the first and second holes are aligned in front of the blower.

24. The convection oven of claim 23 wherein the first and second holes have different diameters.

25. The convection oven of claim 22 wherein the double-wall baffle includes a restrictor plate for selectively reducing the volume of air drawn into the blower compartment to enable operation of the heating element at reduced BTU's.

26. The convection oven of claim 22 further including control means located on an exterior of the oven and means for cooling the control means with cool ambient air before the cool ambient air reaches the heating element.

27. The convection oven of claim 22 wherein the peripheral opening includes at least one cut-out in an outer edge of the double-wall baffle.

* * * * *